US006828286B2

(12) United States Patent
Komiya et al.

(10) Patent No.: US 6,828,286 B2
(45) Date of Patent: Dec. 7, 2004

(54) LUBRICANT COMPOSITIONS

(75) Inventors: Kenichi Komiya, Yokohama (JP); Naozumi Arimoto, Yokohama (JP); Noboru Ishida, Yokohama (JP); Shinichi Shirahama, Yokohama (JP); Eitaro Morita, Yokohama (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 10/411,023

(22) Filed: Apr. 10, 2003

(65) Prior Publication Data

US 2003/0220206 A1 Nov. 27, 2003

Related U.S. Application Data

(63) Continuation of application No. 09/946,233, filed on Sep. 5, 2001, now abandoned.

(30) Foreign Application Priority Data

Sep. 29, 2000 (JP) ..... 2000-301540

(51) Int. Cl.[7] ..... C10M 133/44; C10M 133/56

(52) U.S. Cl. ..... 508/192; 508/226; 508/228; 508/231; 508/242; 508/291; 508/390; 508/518; 508/538; 508/586; 252/77; 252/78.1; 252/78.5

(58) Field of Search ..... 508/192, 228, 508/242, 231, 226, 290, 291

(56) References Cited

U.S. PATENT DOCUMENTS

| | | | |
|---|---|---|---|
| 3,254,025 | A | 5/1966 | LeSuer |
| 3,502,677 | A | 3/1970 | LeSuer |
| 3,513,093 | A | 5/1970 | LeSuer |
| 3,808,131 | A | 4/1974 | Otto, et al. |
| 3,903,005 | A | 9/1975 | Kabiaoui et al. |
| 4,306,984 | A | 12/1981 | Yamaguchi |
| 4,338,205 | A | 7/1982 | Wisotsky |
| 4,428,849 | A | 1/1984 | Wisotsky |
| 4,483,775 | A | 11/1984 | Yamaguchi |
| 4,855,074 | A | 8/1989 | Papay et al. |
| 5,114,602 | A | 5/1992 | Petrille et al. |
| 5,348,674 | A | 9/1994 | Blain et al. |
| 5,389,273 | A | 2/1995 | Papay |
| 5,750,476 | A | 5/1998 | Nibert et al. |
| 5,811,377 | A | 9/1998 | Watts et al. |
| 5,817,605 | A | 10/1998 | Papay |
| 5,840,662 | A | 11/1998 | Nibert et al. |
| 5,972,851 | A | 10/1999 | Srinivasan et al. |
| 6,303,546 | B1 | 10/2001 | Hata et al. |
| 6,352,962 | B1 | 3/2002 | Hata et al. |

FOREIGN PATENT DOCUMENTS

| | | |
|---|---|---|
| JP | 9-506927 | 7/1997 |
| JP | 9-202890 | 8/1997 |
| JP | 2000-500790 | 1/2000 |
| WO | WO 97/14772 | 4/1997 |
| WO | WO 99/11743 | 3/1999 |

*Primary Examiner*—Ellen M. McAvoy
(74) *Attorney, Agent, or Firm*—Akin Gump Strauss Hauer & Feld LLP

(57) ABSTRACT

Lubricant compositions comprises a lubricant base oil and one or more compounds resulting the modification of a succinimide represented by formula (1) or (2)

(1)

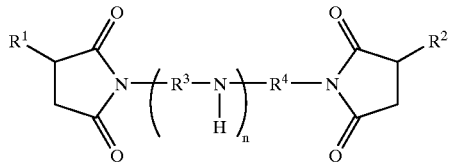

(2)

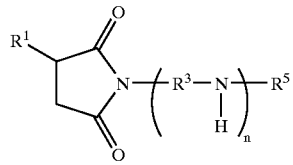

wherein $R^1$ and $R^2$ may be the same or different and are each independently a hydrocarbon group having 8 to 30 carbon atoms, $R^3$ and $R^4$ may be the same or different and are each independently a hydrocarbon group having 1 to 4 carbon atoms, $R^5$ is hydrogen or a hydrocarbon group having 1 to 30 carbon atoms, n is an integer from 1 to 7. The lubricant compositions have a long-lasting anti-shudder property, an enhanced transmission capacity for a wet clutch, and an excellent shifting property.

20 Claims, No Drawings

LUBRICANT COMPOSITIONS

CROSS-REFERENCE TO RELATED APPLICATION

This application is a continuation of co-pending U.S. patent application Ser. No. 09/946,233, filed Sep. 5, 2001, now abandoned.

BACKGROUND OF THE INVENTION

1. Field of the Invention

The present invention relates to lubricant compositions, and more particularly to lubricant compositions which are not decreased in anti-shudder property over an extended period of time and have an enhanced transmission torque capacity for wet clutches and/or wet brakes, suitable for automatic transmissions and continuously variable transmissions.

2. Description of the Prior Art

Most of the automatic transmissions and continuously variable transmissions equipped in automobiles are provided with torque converters which transmit engine torque via a lubricant to the transmissions. The torque converters is so structured that the power can not be transmitted if the difference in rotation between the input side (the engine side) and the output side (the transmission side) is not developed. This rotation difference causes the transmission to be decreased in power transmitting efficiency. With the background of the issues concerning environments, demands have been increasing for automobiles which are fuel efficient for the purpose of reducing the amount of carbon dioxide gas discharged. In connection with this, the transmissions are required to be more increased in power transmitting efficiency. Recently, as one of the measures, there have been used torque converters equipped with wet clutch hereinafter referred to as "torque converter clutch" which in addition to fluid coupling, transmit the engine torque directly to the transmission mechanism variously according to the running conditions.

However, while the torque converter clutch is working, the comfort on driving is greatly affected at the change of engine torque. Therefore, in the conventional mechanisms, the torque converter clutch is worked only at high road speeds at which the changes of the engine torque are lessen, and is not worked at low road speeds. For this reason, the transmission loss in the torque converters can not be avoided at low road speeds as well as at the time of starting and thus the improvement of fuel economy as expected can not be achieved.

Recently, in order to reduce such a transmission loss, there has been developed and introduced a so-called slipping controlling system in which the torque converter clutch works at low road speeds as well and absorbs the vibration resulting from the change of engine torque, by relative slippage of the clutch.

However, abnormal vibration, known as shudder, in the vehicle frequently occurs at the torque converter clutch's friction surface when the slip-control of the clutch operates, and discomforts the driving conditions. In order to prevent the shudder phenomenon, it is highly demanded to provide a lubricant which has an excellent durability of anti-shudder performance resulting from the improvement of friction coefficient ($\mu$)-sliding velocity (V) characteristics so as to have a friction coefficient ($\mu$) which increases as sliding velocity (V) increases.

The further improvement of anti-shudder durability has been demanded because of the progressed enlargement of the low-speed range in which the slip-controlling mechanism operates.

The automatic transmissions and continuously variable transmissions have wet clutches in their gear-change mechanism and front and rear drive switching mechanism. If the friction property of such clutches is poor, a transmission shock occurs at the change of speed, resulting in discomfort of driving. Therefore, a lubricant for automatic transmissions is required to have an excellent shifting property so as to decrease the shock occurring at the time of clutch engagement.

As one of the measures for improving the anti-shudder durability and shifting property of the lubricant, it has been proposed to blend therewith large amounts of friction modifiers. However, depending on the type of friction modifier, the addition thereof would extremely decrease the friction coefficient of the wet clutch and fail to attain a transmission torque capacity.

The anti-shudder durability and shifting property and the transmission torque capacity are in a trade-off relation. Therefore, it is desired to develop a lubricant composition having all of these properties.

With the background of the foregoing, the object of the present invention is to provide a novel lubricant composition which can retain an anti-shudder durability for extended periods and has a high transmission torque capacity and improved shifting property.

BREIF SUMMARY OF THE INVENTION

After intensive research efforts made to solve the foregoing problems, it was found that the problems can be solved with a lubricant composition comprising a lubricant base oil blended with compounds obtained by modifying specific succinimides.

That is, the present invention provides a lubricant composition which comprises a lubricant base oil and one or more compounds selected from the group consisting of those resulting from the modification of succinimides represented by formula (1) or (2)

(1)

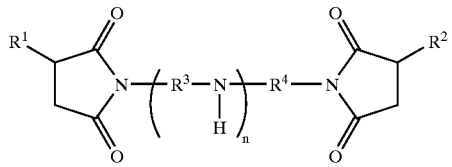

(2)

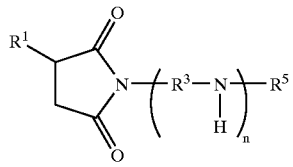

wherein $R^1$ and $R^2$ may be the same or different and are each independently a hydrocarbon group having 8 to 30 carbon atoms, $R^3$ and $R^4$ may be the same or different and are each independently a hydrocarbon group having 1 to 4 carbon atoms, $R^5$ is hydrogen or a hydrocarbon group having 1 to 30 carbon atoms, and n is an integer from 1 to 7.

$R^1$ and $R^2$ in formula (1) or (2) are preferably branched hydrocarbon groups having 8 to 30 carbon atoms.

In formula (1) or (2), n is preferably an integer from 1 to 3.

The modified succinimide compounds are preferably those resulting from the modification of succinimides of formula (1) or (2) with one or more compounds selected from the group consisting of boric acids, phosphoric acids, carboxylic acids, and derivatives thereof.

The lubricant composition further contains one or more friction modifiers and/or metal-based detergents.

The lubricant composition is preferably used in automatic transmissions and/or continuously variable transmissions.

The lubricant composition is preferably used in transmissions equipped with a wet clutch and/or a wet break.

DETAILED DESCRIPTION OF THE INVENTION

The present invention will be described in more details below.

Lubricating base oils useful in this invention are any mineral oils and/or synthetic oils which are usually used as lubricant base oils.

Specific examples of the mineral oils include paraffinic- and naphthenic-mineral oils which are produced by subjecting lubricant fractions resulting from the atmospheric distillation and the vacuum distillation of crude oil to one or more refining processes such as solvent deasphalting, solvent extraction, hydrocracking, solvent dewaxing, catalytic dewaxing, hydro-refining, sulfuric acid washing, and clay treatment in suitable combination; and n-paraffins. Particularly preferred are those improved in low-temperature flowability by dewaxing after solvent- or hydro-refining. With the objective of improving low temperature flowability and oxidation stability of the resulting composition, it is preferred to use mineral oils of which %Cp specified by the n-d-m method of ASTM-D 3238-80 is 60 or greater and preferably 70 or greater, %CA specified by the same is 10 or less and preferably 5 or less, and viscosity index is 95 or greater and preferably 100 or greater.

Although not restricted, examples of synthetic oils are one or more compounds selected from poly-α-olefins such as 1-octene oligomer, 1-decene oligomer, and ethylene-propylene oligomer, and hydrides thereof; isobutene oligomers and hydrides thereof; isoparaffins; alkylbenzenes; alkylnaphthalenes; diesters such as ditridecyl glutarate, di-2-ethylhexyl adipate, diisodecyl adipate, ditridecyl adipate, and di-2-ethylhexyl sebacate; polyol esters such as trimethylolpropane caprylate, trimethylolpropane pelargonate, pentaerythritol-2-ethyl hexanoate, and pentaerythritol pelargonate; polyoxyalkylene glycols; dialkyldiphenyl ethers; and polyphenyl ethers. When consideration is given to the solubility of additives, these synthetic oils are preferably used in the form of mixtures thereof or mixtures with mineral oils rather than being used alone.

No particular limitation is imposed on the viscosity of the lubricant base oils. However, the kinematic viscosity at 100° C. of the lubricant base oil is preferably from 1 to 20 $mm^2/s$, and more preferably from 1.5 to 10 $mm^2/s$.

The modified succinimide compounds hereinafter referred to as Component (A) useful in the present invention are selected from the group consisting of compounds resulting from the modification of succinimides represented by formula (1) or (2) below with boric acids, phosphorus acids, carboxylic acids, derivatives thereof, sulfuric compounds, and triazoles:

(1)

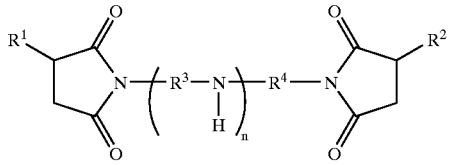

(2)

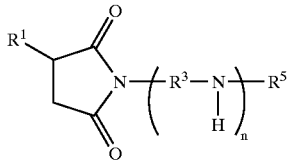

In formula (1), $R^1$ and $R^2$ may be the same or different and are each independently a straight-chain or branched hydrocarbon group having 8 to 30 carbon atoms and preferably 12 to 25 carbon atoms. Examples of such a hydrocarbon group are octyl, octenyl, nonyl, nonenyl, decyl, decenyl, dodecyl, dodecenyl, octadecyl, and octadecenyl groups and hydrocarbon groups having up to 30 carbon atoms. Hydrocarbon groups having less than 8 carbon atoms or exceeding 30 carbon atoms are not preferred because they are not effective in improving the anti-shudder property. Preferred are branched hydrocarbon groups having 8 to 30 carbon atoms, and particularly preferred are branched hydrocarbon groups having 10 to 25 carbon atoms. The use of a branched hydrocarbon group having 8 to 30 carbon atoms is contributive to the production of a lubricant composition having a higher torque capacity than the use of straight-chain hydrocarbon groups.

In formula (1) or (2), $R^3$ and $R^4$ may be the same or different and are each independently a hydrocarbon group having 1 to 4 carbon atoms, and preferably an alkylene group having 2 or 3 carbon atoms, such as ethylene and propylene.

In formula (1) or (2), $R^5$ is hydrogen or a straight-chain or branched hydrocarbon group having 1 to 30 carbon atoms and preferably a branched hydrocarbon group having 8 to 30 carbon atoms and preferably 10 to 25 carbon atoms.

In formula (1) or (2), n is an integer from 1 to 7, preferably from 1 to 3, and particularly preferably 1. If n is an integer from 1 to 3, the resulting lubricant composition has a higher torque capacity. If n is 1, the resulting composition has a more higher torque capacity.

Any suitable method may be employed for producing succinimides represented by formula (1) or (2) For example, they can be obtained by reacting an alkyl or alkenyl anhydrous succinimide with a polyamine. More specifically, a bissuccinimide of formula (1) may be obtained by adding dropwise 1 mol of succinic anhydride having a straight-chain or branched alkyl or alkenyl group to 0.5 mol of polyamine such as diethylenetriamine, triethylenetetramine, and tetraethylenepentamine under a nitrogen atmosphere at a temperature of 130 to 180° C. and preferably 140 to 175° C. and then reacting the mixture for 1 to 10 hours and preferably 2 to 6 hours, followed by removing the water thus formed. A monosuccinimide of formula (2) wherein $R^5$ is hydrogen may be obtained by adding dropwise 1 mole of succinic anhydride as described above to 1 mole or more of polyamine as described above and reacting the mixture under the same conditions, followed by distilling out the unreacted polyamine. A monosuccinimide of formula (2) wherein $R^5$ is a hydrocarbon group having 1 to 30 carbon atoms may be obtained by reacting N-octadecyl-1,3-propanediamine with succinic anhydride as described above under the same conditions as described above.

Boric acids and derivatives thereof used for modifying succinimides represented by formula (1) or (2) are exemplified by boric acids, boric acid salts and borates Specific examples of the boric acids are orthoboric acid, metaboric acid, and tetraboric acid. Specific examples of the boric acid salts are alkaline metal salts, alkaline earth metal salts or ammonium salts of boric acid. More specific examples are lithium berates such as lithium metaborate, lithium tetraborate, lithium pentaborate, lithium perborate; sodium borates such as sodium metaborate, sodium diborate, sodium tetraborate, sodium pentaborate, sodium hexaborate, and sodium octaborate; potassium borates such as potassium metaborate, potassium tetraborate, potassium pentaborate, potassium hexaborate, and potassium octaborate; calcium borates such as calcium metaborate, calcium diborate, tricalcium tetraborate, pentacalcium tetraborate, and calcium hexaborate; magnesium borates such as magnesium metaborate, magnesium diborate, trimagnesium tetraborate, pentamagnesium tetraborate, and magnesium hexaborate; and ammonium borates such as ammonium metaborate, ammonium tetraborate, ammonium pentaborate, and ammonium octaborate. Berates may be esters of boric acid with an alkyl alcohol having 1 to 6 carbon atoms. Specific examples are monomethylborate, dimethylborate, trimethylborate, monoethylborate, diethylborate, triethylborate, monopropylborate, dipropylborate, tripropylborate, monobutylborate, dibutylborate, and tributylborate.

Specific examples of phosphoric acids and derivatives used for modifying succinimides represented by formula (1) or (2) are orthophosphoric acid, methaphosphoric acid, phosphorus acid, polyphosphoric acid, and compounds derived from the esterification thereof.

Specific examples of carboxylic acids and derivatives used for modifying succinimides represented by formula (1) or (2) are monocarboxylic acids having 1 to 30 carbon atoms, such as formic acid, acetic acid, glycolic acid, propionic acid, lactic acid, butyric acid, valeric acid, caproic acid, enanthic acid, caprylic acid, pelargonic acid, capric acid, undecylic acid, lauric acid, tridecanoic acid, myristic acid, pentadecanoic acid, palmitic acid, margaric acid, stearic acid, oleic acid, nonadecanoic acid, and eicosanoic acid; polycarboxylic acids having 2 to 30 carbon atoms, such as oxalic acid, phthalic acid, trimellitic acid, and pyromellitic acid; anhydrides thereof; and esterified compounds thereof. Among these, preferred are carboxylic acids having 8 to 20 carbon atoms and derivatives thereof, and particularly preferred are stearic acid and oleic acid.

Specific examples of sulfuric compounds used for modifying succinimides represented by formula (1) or (2) are dialkyldithiophosphates, dialkenyldithiophosphates, dialkanoldithiophosphates, diaryldithiophosphates, and sulfonic acids.

Specific examples of triazoles used for modifying succinimides represented by formula (1) or (2) are benzotriazole, tolyltriazole, and tetratriazole.

Although not restricted, Component (A) may be prepared by neutralizing or amidizing part or all of the amino groups and/or imide groups because the reacting weight ratio of a compound represented by formula (1) or (2) to the above-described boric acids, phosphoric acids, carboxylic acids, derivatives thereof, or sulfuric compounds can be arbitrary adjusted.

More specifically, Compound (A) may be obtained by reacting 1 mol of a compound represented by formula (1) or (2) with boric acids, phosphoric acids, carboxylic acids, derivatives thereof, or sulfuric compounds in an amount of 0.4 n mol or more, preferably 0.6 n mole or more and particularly preferably 0.9 n mol or more (n corresponds to that of formula (1) or (2)), under a nitrogen atmosphere while heating. If the reaction ratio of boric acids, phosphoric acids, carboxylic acids, derivatives thereof, or sulfuric compounds to 1 mol of a compound represented by formula (1) or (2) is 0.4 n mol or more, the resulting lubricant composition can be more enhanced in transmission torque capacity. Whereas, if such a ratio is less than 0.4 n mol, the anti-shudder durability as sought by the present invention can not be attained.

One of more preferred examples of the production method of Component (A) is as follows. 1 mol of diethylenetriamine bisisooctadecenylsuccinimde and 1 mol of powdered boric acid are put into a synthesizing vessel and reacted with stirring under a nitrogen atmosphere at a temperature of 80 to 150° C. and preferably 90 to 130° C. for 5 to 12 hours with separating the water thus produced until the unreacted powdery boric acid disappears. A solution of the reaction product diluted with toluene was filtered by pressure with a 1 μm Teflon filter. The filtrate is put under vacuum conditions at a temperature of 70 to 110° C. so as to remove the toluene thereby obtaining a compound represented by formula (3) below:

(3)

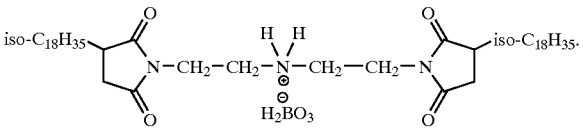

Alternatively, a suitable amount of toluene is added to 1 mol of diethylenetriamine bisisooctadecenylsuccinimide in a synthesizing vessel under a nitrogen atmosphere. 1 mol of phosphoric acid is added dropwise to the mixture with stirring and reacted at room temperature to 100° C. for 2 to 10 hours, and preferably at room temperature for 1 to 5 hours at the initial reaction stage and then at a temperature of 70 to 90° C. for 1 to 5 hours. The toluene is completely removed from the reaction product under vacuum conditions at a temperature of 70 to 130° C. thereby obtaining a compound represented by formula (4) below:

(4)

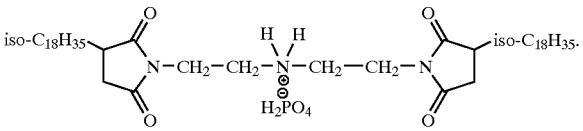

Further alternatively, a suitable amount of toluene is added to 1 mol of diethylenetriamine bisisooctadecenylsuccinimide in a synthesizing vessel under a nitrogen atmosphere. A toluene solution of 1 mol of oleic acid is slowly added dropwise to the mixture with stirring and reacted at a temperature of 60 to 100° C. for 2 to 10 hours, and preferably at a temperature of 70 to 130° C. for 3 to 6 hours. The toluene is completely removed from the reaction product under vacuum conditions at a temperature of 70 to 130° C. thereby obtaining a compound represented by formula (5) below:

(5)

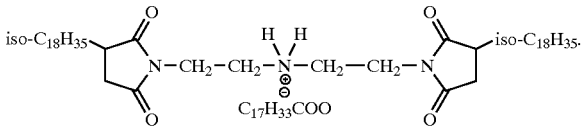

Although a method of producing Component (A) using oleic acid is described above, Component (A) can be produced using lauric acid or stearic acid instead of oleic acid.

Component (A) may contain a mixture of a compound represented by formula (1) or (2), and boric acid, phosphoric acid, carboxylic acid, derivatives thereof or a sulfuric compound which are reacted by the above-described methods.

Compounds resulting from the modification of a succinimide of formula (1) or (2) with one or more compounds selected from boric acids, phosphoric acids, carboxylic acids, derivatives thereof, and sulfuric compounds is used as Component (A) of the lubricant composition of the present invention. However, preferred for Component (A) are those resulting from the modification of a succinimide of formula (1) or (2) with a carboxylic acid having 10 to 25 carbon atoms, such as lauric acid, stearic acid and oleic acid with the objective of well-balanced transmission torque capacity and speed-change property. It is preferred to use compounds resulting from the modification of bis-type succinimides of formula (1) than those resulting from the modification of mono-type succinimides because the use of the former is contributive to the production of a lubricant composition having a higher transmission torque capacity.

No particular limitation is imposed on the content of Component (A) in the lubricant composition of the present invention. However, the lower limit content is preferably 0.01 percent by mass, and more preferably 0.1 percent by mass, while the upper limit content is preferably 6 percent by mass, and more preferably 4 percent by mass, based on the total mass of the lubricant composition. The content of Component (A) in less than the lower limit is less effective in maintaining an anti-shudder durability and an excellent speed-change property, while the content of Component (A) in excess of the upper limit fails to attain effects as expected.

In the present invention, a lubricant composition having an excellent anti-shudder durability and an enhanced transmission torque capacity can be obtained by blending a lubricant base oil with one or more compounds selected from Components (A). However, friction modifier and/or metal-based detergents may be added to the composition alone or in combination. By blending these additives, the resulting lubricant can possess a more excellent initial speed-change property while maintaining a transmission torque capacity and an anti-shudder durability.

Friction modifiers useful in the present invention may be any type of those which are used for lubricants. Examples of such friction modifiers are amine compounds, fatty acid esters, fatty acid amides and fatty acid metallic salt, all having unmodified succinimides represented by formula (1) or (2) and alkyl or alkenyl groups having 6 to 30 carbon atoms, preferably straight-chain or branched alkyl or alkenyl groups having 6 to 30 carbon atoms.

Unmodified succinimides represented by formula (1) or (2) may be contained as an unreacted component in the resulting lubricant composition during the preparation of Component (A). The unreacted component may be blended as a friction modifier. In this case, preferred are bis-type succinimides as represented by formula (1).

Eligible amine compounds are straight-chain or branched, preferably straight-chain monoamines having 6 to 30 carbon atoms; straight-chain or branched, preferably straight-chain polyamines having 6 to 30 carbon atoms; alkylene oxide adducts thereof; salts of these amine compounds and phosphates or phosphites; and products resulting from the modification of such salts with boric acids. Specific examples are amine compounds such as lauryl amine, lauryl diethylamine, lauryl diethanolamine, dodecyldipropanolamine, palmitylamine, stearylamine, stearyltetraethylenepentamine, oleylamine, oleylpropylenediamine, oleyldiethanolamine, N-hydroxyethyloleylimidazolyne; alkylene oxide adducts of these amine compounds; salts of these amine compounds and phosphates such as di-2-ethylhexylphosphate or phosphites such as 2-ethylhexylphosphite; boric acid-modified products of such salts; and mixtures thereof.

Eligible fatty acid esters are esters of straight-chain or branched, preferably straight-chain fatty acids having 7 to 31 carbon atoms and aliphatic monohydric alcohols or aliphatic polyhydric alcohols. Specific examples are partial esters of glycerin such as glycerol monolaurate, glycerol monoisolaurate, glycerol dilaurate, glycerol diisolaurate, glycerol monomyristate, glycerol monoisomyristate, glycerol dimyristate, glycerol diisomyristate, glycerol monopalmitate, glycerol monoisopalmitate, glycerol dipalmitate, glycerol diisopalmitate, glycerol monostearate, glycerol monoisostearate, glycerol distearate, glycerol diisostearate, glycerol monooleate, glycerol monoisooleate, glycerol dioleate, glycerol diisooleate, glycerol monoisooleate, glycerol dioleate, and glycerol isooleate; partial esters of trimethylolethane such as trimethylolethane monolaurate, trimethylolethane monoisolaurate, trimethylolethane dilaurate, trimethylolethane diisolaurate, trimethylolethane monomyristate, trimethylolethane monoisomyristate, trimethylolethane dimyristate, trimethylolethane diisomyristate, trimethylolethane monopalmitate, trimethylolethane monoisopalmitate, trimethylolethane dipalmitate, trimethylolethane diisopalmitate, trimethylolethane monostearate, trimethylolethane monoisostearate, trimethylolethane distearate, trimethylolethane diisostearate, trimethylolethane monooleate, trimethylolethane monoisooleate, trimethylolethane dioleate, and trimethylolethane diisooleate; partial esters of trimethylolpropane such as trimethylolpropane monolaurate, trimethylolpropane monoisolaurate, trimethylolpropane dilaurate, trimethylolpropane diisolaurate, trimethylolpropane monomyristate, trimethylolpropane monoisomyristate, trimethylolpropane monopalmitate, trimethylolpropane monoisopalmitate, trimethylolpropane dipalmitate, trimethylolpropane diisopalmitate, trimethylolpropane monostearate, trimethylolpropane monoisostearate, trimethylolpropane diisostearate, trimethylolpropane monooleate, trimethylolpropane monoisooleate, trimethylolpropane dioleate, and trimethylolpropane diisooleate; partial esters of pentaerythritol such as pentaerythritol monolaurate, pentaerythritol monoisolaurate, pentaerythritol dilaurate, pentaerythritol diisolaurate, pentaerythritol trilaurate, pentaerythritol triisolaurate, pentaerythritol monomyristate, pentaerythritol monoisomyristate, pentaerythritol dimyristate, pentaerythritol diisomyristate, pentaerythritol myristate, pentaerythritol triisomyristate, pentaerythritol monopalmitate, pentaerythritol monoisopalmitate, pentaerythritol dipalmitate, pentaerythritol diisopalmitate, pentaerythritol tripalmitate, pentaerythritol triisopalmitate, pentaerythritol monostearate, pentaerythritol monoisostearate, pentaerythritol distearate, pentaerythritol diisostearate, pentaerythritol tristearate, pentaerythritol triisostearate, pentaerythritol monooleate, pentaerythritol monoisooleate, pentaerythritol dioleate, pentaerythritol diisooleate, pentaerythritol trioleate, and pentaerythritol triisooleate; partial esters of sorbitan such as sorbitan monolaurate, sorbitan monoisolaurate, sorbitan dilaurate, sorbitan diisolaurate, sorbitan trilaurate, sorbitan triisolaurate, sorbitan monomyristate, sorbitan monoisomyristate, sorbitan dimyristate, sorbitan diisomyristate, sorbitan trimyristate, sorbitan triisomyristate, sorbitan monopalmitate, sorbitan monoisopalmitate, sorbitan dipalmitate, sorbitan diisopalmitate, sorbitan tripalmitate, sorbitan triisopalmitate, sorbitan monostearate, sorbitan monoisostearate, sorbitan distearate, sorbitan diisostearate, sorbitan tristearate, sorbitan triisostearate, sorbitan monooleate, sorbitan monoisooleate, sorbitan dioleate, sorbitan diisooleate, sorbitan trioleate, and sorbitan triisooleate; and mixtures thereof.

Eligible fatty acid amides are amides of straight-chain or branched, preferably straight-chain fatty acids having 7 to 31 carbon atoms and aliphatic monoamines or aliphatic polyamines. Specific examples are lauric acid amide, lauric acid diethanolamide, lauric acid monopropanolamide, myristic acid amide, myristic acid diethanolamide, myristic acid monopropanolamide, palmitic acid amide, palmitic acid diethanolamide, palmitic acid monopropanolamide, stearic acid amide, stearic acid diethanolamide, stearic acid monopropanolamide, oleic acid amide, oleic acid diethanolamide, oleic acid monopropanolamide, coconut oil fatty acid amide, coconut oil fatty acid diethanolamide, coconut oil fatty acid monopropanolamide, synthetic-mixed fatty acid amide having 12 or 13 carbon atoms, synthetic-mixed fatty acid diethanolamide having 12 or 13 carbon atoms, synthetic-mixed fatty acid monopropanolamide having 12 or 13 carbon atoms, and mixtures thereof.

Eligible fatty acid metallic salts are alkaline earth metal salts such as magnesium salt and calcium salt or zinc salt of straight-chain or branched, preferably straight-chain fatty acids having 7 to 31 carbon atoms. Specific examples are calcium laurate, calcium myristate, calcium palmitate, calcium stearate, calcium oleate, coconut oil fatty acid calcium, synthetic-mixed fatty acid calcium having 12 or 13 carbon atoms, zinc laurate, zinc myristate, zinc palmitate, zinc stearate, zinc oleate, coconut oil fatty acid zinc, synthetic-mixed fatty acid zinc having 12 or 13 carbon atoms, and mixtures thereof.

In the present invention, one or more compounds selected from these friction modifiers may be blended in suitable amounts. However, the content of the friction modifiers is usually within the range of 0.01 to 5 percent by mass and preferably 0.03 to 3 percent by mass, based on the total mass of the lubricant composition.

Metal-based detergents useful in the present invention may be any compounds which are usually used as detergents for lubricants. Sulfonates, phenates, salicylates and naphthenates of alkaline metals or alkaline earth metals may be used alone or in combination. The alkaline metals may be sodium and potassium. The alkaline earth metals may be calcium and magnesium. Preferred metal-based detergents are sulfonates, phenates, and salicylates of calcium or magnesium. These metal-based detergents have a total base number of 0 to 500 mgKOH/g. These metal-based detergents are blended in an amount of 0.001 to 0.5 percent by mass of alkaline metal or alkaline earth metal, based on the total mass of the lubricant composition. In order to avoid the decrease of friction coefficient due to the clogging of the friction material of a wet clutch, the upper limit of the metal-based detergents is 0.1 percent by mass and preferably 0.05 percent by mass or less of an alkaline metal or alkaline earth metal, based on the total mass of the lubricant composition.

In order to further enhance the capabilities of the lubricant composition of the present invention, it may be blended with known lubricant additives such as ashless dispersants, viscosity index improvers, phosphorus-based additives, extreme pressure additives, oxidation inhibitors, corrosion inhibitors, anti-foaming agents and dyes. These additives may be added alone or in combination.

Ashless dispersants useful in the present invention may be any compounds which are used as ashless dispersants for lubricants, such as nitrogen-containing compounds having in their molecule at least one alkyl or alkenyl group having 40 to 400, preferably 60 to 350 carbon atoms; bis or mono type succinimides having alkenyl groups having 40 to 400, preferably 60 to 350 carbon atoms; products obtained by modifying these compounds with the above-described boric acids, phosphorus acids, carboxylic acids, derivatives thereof, or sulfuric compounds. One or more of these compounds may be used alone or in combination. The alkyl or alkenyl group may be straight-chain or branched and may be a branched alkyl or alkenyl group derived from oligomers such as propylene, 1-butene and isobutylene or cooligomers of ethylene and propylene. Preferred are polybutenyl groups obtained by polymerizing butene mixtures or highly purified isobutylene using an aluminum-based catalyst or a boron fluoride-based catalyst. Particularly preferred are those obtained by removing the halogen compounds from the polybutenyl groups. Alkyl or alkenyl groups having less than 40 carbon atoms are not preferred because the resulting composition becomes poor in a detergent dispersing property, while those having more than 400 carbon atoms are not preferred because the resulting composition may be deteriorated in low-temperature flowability. Although not restricted, the content of these compounds in the lubricant composition of the present invention is from 0.1 to 10 percent by mass, preferably 1 to 8 percent by mass, based on the total mass of the composition. With the objective of the further enhancement of a speed-change property, ashless dispersants useful in the present invention are succinimides having a weight-average molecular weight of 700 to 3,500, preferably 900 to 2,000 and/or those modified with boric acid.

With the objective of the enhancement of the ability to avoid the peel-off of the clutch, the ashless dispersants are blended with preferably a boric acid-modified succinimide, more preferably two or more boric acid-modified succinimides.

Viscosity index improvers useful in the present invention may be non-dispersion-type viscosity index improvers such as copolymers of one or more monomers selected from various types of methacrylates or hydrides of such copolymers and dispersion-type viscosity index improvers such as those obtained by copolymerizing various types of methacrylates containing a nitrogen compound. Specific examples of another types of viscosity index improver are non-dispersion type- and dispersion type-ethylene-$\alpha$-olefin copolymers, of which $\alpha$-olefin may be propylene, 1-butene and 1-pentene, hydrides thereof, polyisobutylenes, hydrides thereof, styrene-diene hydrogenated copolymers, styrene-maleic anhydride ester copolymers and polyalkylstyrenes.

It is necessary to select the molecular weight of the viscosity index improver in view of shear stability.

Specifically, the molecular weight of the dispersion type- and non-dispersion type-polymethacrylates should be within the range of 5,000 to 150,000, preferably 5,000 to 35,000, and the molecular weight of the polyisobutylenes and hydrides thereof should be within the range of 800 to 5,000, preferably 1,000 to 4,000. The molecular weight of the polyisobutylene and hydrides thereof should be 800 to 5,000, preferably 1,000 to 4,000. When using the ethylene-α-olefin copolymers and hydrides thereof, it is preferred to use those of 800 to 150,000, preferably 3,000 to 12,000 in molecular weight.

Among these viscosity index improvers, the ethylene-α-olefin copolymers and hydrides thereof are particularly contributive to the production of a lubricant composition which has an excellent shear stability.

One or more of the above-described viscosity index improvers may be added in a suitable amount to the inventive lubricant composition. The viscosity index improver may be added in an amount of 0.1 to 40.0 percent by mass, based on the total mass of the composition.

Phosphorus-containing additives useful in the present invention may be any phosphorus compounds which are usually used as phosphorus-containing additives for lubricants, such as alkyldithiophosphates, zinc alkyldithiophosphates, monophosphates, diphosphates, triphosphates, monophosphites, diphosphites, triphosphites, and salts of these esters and amines or alkanolamines.

Although not restricted, the content of the phosphorus-containing additives is preferably 0.005 to 0.2 percent by mass of phosphorus, based on the total mass of the lubricant. The content less than 0.005 percent by mass of phosphorus would be poor in an anti-wear property, while the content in excess of 0.2 percent by mass of phosphorus would result in the deterioration of oxidation stability.

Extreme pressure additives useful in the present invention may be any compounds which are usually used as extreme pressure additives for lubricants. Extreme pressure additives may be sulfur-containing compounds such as disulfides, olefin sulfides and sulfurized fats and oils. One or more of these compounds is preferably added in an amount of 0.01 to 5.0 percent by mass based on the total mass of the lubricant.

Oxidation inhibitors useful in the present invention are phenol-based or amine-based compounds which may be alkylphenols such as 2-6-di-tert-butyl-4-methylphenol, bisphenols such as methylene-4,4-bisphenol(2,6-di-tert-butyl-4-methy lphenol); naphthylamines such as phenyl-α-naphthylamine and dialkyldiphenylamines; zinc dialkyldithiophosphates such as zinc di-2-ethylhexyldithiophosphate; and esters of 3,5-di-tert-butyl-4-hydroxyphenyl fatty acid (propionic acid) with a mono- or poly-hydric alcohol such as methanol, octadecanol, 1,6 hexanediol, neopentyl glycol, thiodiethylene glycol, triethylene glycol or pentaerythritol.

One or more of these oxidation inhibitors may be added in suitable amounts. However, the content of the oxidation inhibitor is preferably within the range of 0.01 to 5.0 percent by mass, based on the total mass of the lubricant.

Corrosion inhibitors useful in the present invention may be any compounds which are usually used as corrosion inhibitors for lubricants, such as benzotriazoles, tolyltriazoles, thiadiazoles and imidazoles. One or more of these compounds is preferably added in an amount of 0.01 to 3.0 percent by mass, based on the total mass of the lubricant.

Anti-foaming agents useful in the present invention may be any compounds which are usually used as anti-foaming agents for lubricants, which may be silicones, such as dimethylsilicone and fluorosilicone. One or more of these compounds is preferably added in an amount of 0.001 to 0.05 percent by mass, based on the composition.

Any types of dye may be added generally in an amount of 0.001 to 1.0 percent by mass, based on the total mass of the composition.

Examples of the present invention will now be provided, with the understanding that the invention is in no way limited by these examples.

EXAMPLES 1 TO 14 AND COMPARATIVE EXAMPLES 1 TO 4

Lubricant compositions (Inventive Examples 1 to 14) for automatic transmissions according to the present invention are prepared in accordance with the formulations shown in Table 1. The following anti-shudder durability test and speed-change clutch friction property test were conducted for each of the compositions so as to evaluate the anti-shudder durability, speed-change property for a speed-change clutch, and transmission torque capacity. The results are shown in Table 1.

For comparison, lubricant compositions of Comparative Examples 1 to 4 were also prepared in accordance with the formulations shown in Table 2 and the same evaluation tests were conducted therefor. The results are shown in Table 2.

[Anti-Shudder Durability Test]

A low-speed slipping test was conducted based on "Test method for anti-shudder performance of automatic transmission fluids" prescribed in JASO M349-98 where an oil temperature was changed from 120° C. to 140° C. . The evaluation of anti-shudder durability was indicated by a ratio of the durability of the oil usually used in the above test method, as a criterion to those of Inventive and Comparative Examples.

The measurement was conducted at intervals of 0, 6, 12, and 24 hours and thereafter at intervals of 24 hours.

A lubricant composition is considered to have a good anti-shudder durability when the durability exceeds that of the criterion oil, that is, 72 hours. The test was terminated when the durability is 4 times greater than that of the criterion oil, that is, exceeds 288 hours.

[Speed-Change Clutch Friction Property Test]

SAE No. 2 test was conducted in accordance with "Test method for friction property of automatic transmission fluids" prescribed in JASO M348-95. The resulting $\mu s$ and $\mu 0/\mu d$ were used as indexes of transmission torque capacity and shifting property, respectively.

TABLE 1

| | | Inventive Examples | | | | | | |
|---|---|---|---|---|---|---|---|---|
| | | 1 | 2 | 3 | 4 | 5 | 6 | 7 |
| Refined mineral oil[1)] | mass % | 86.697 | 86.697 | 86.697 | 86.697 | 86.697 | 86.697 | 86.697 |
| Oleic acid-modified compound[2)] | mass % | 3 | — | — | — | — | — | — |
| Boric acid-modified compound[3)] | mass % | — | 3 | — | — | — | — | — |
| Phosphoric acid-modified compound[4)] | mass % | — | — | 3 | — | — | — | — |
| Lauric acid-modified compound[5)] | mass % | — | — | — | 3 | — | — | — |
| Lauric acid-modified compound[6)] | mass % | — | — | — | — | 3 | — | — |
| Oleic acid-modified compound[7)] | mass % | — | — | — | — | — | 3 | — |
| Stearic acid-modified compound[8)] | mass % | — | — | — | — | — | — | 3 |
| Oleic acid-modified compound[9)] | mass % | — | — | — | — | — | — | — |
| Oleic acid-modified compound[10)] | mass % | — | — | — | — | — | — | — |
| Oleic acid-modified compound[11)] | mass % | — | — | — | — | — | — | — |
| Oleic acid-modified compound[12)] | mass % | — | — | — | — | — | — | — |
| Succinimide A[13)] | mass % | — | — | — | — | — | — | — |
| Succinimide B[14)] | mass % | — | — | — | — | — | — | — |
| Succinimide C[15)] | mass % | — | — | — | — | — | — | — |
| Friction modifier A[16)] | mass % | — | — | — | — | — | — | — |
| Friction modifier B[17)] | mass % | — | — | — | — | — | — | — |
| Metal-based detergent[18)] | mass % | — | — | — | — | — | — | — |
| Ashless dispersant[19)] | mass % | 3 | 3 | 3 | 3 | 3 | 3 | 3 |
| Boron-modified ashless dispersant[20)] | mass % | 1 | 1 | 1 | 1 | 1 | 1 | 1 |
| Viscosity index improver[21)] | mass % | 5 | 5 | 5 | 5 | 5 | 5 | 5 |
| Anti-wear agent[22)] | mass % | 0.2 | 0.2 | 0.2 | 0.2 | 0.2 | 0.2 | 0.2 |
| Oxidation inhibitor A[23)] | mass % | 0.5 | 0.5 | 0.5 | 0.5 | 0.5 | 0.5 | 0.5 |
| Oxidation inhibitor B[24)] | mass % | 0.5 | 0.5 | 0.5 | 0.5 | 0.5 | 0.5 | 0.5 |
| Corrosion inhibitor[25)] | mass % | 0.1 | 0.1 | 0.1 | 0.1 | 0.1 | 0.1 | 0.1 |
| Anti-foaming agent[26)] | mass % | 0.003 | 0.003 | 0.003 | 0.003 | 0.003 | 0.003 | 0.003 |
| Transmission torque capacity SAE No. 2 $\mu s$ (2000 cycles) | | 0.110 | 0.140 | 0.136 | 0.145 | 0.149 | 0.140 | 0.139 |
| Shifting property SAE No.2 $\mu 0/\mu d$ (100 cycles) | | 0.97 | 1.02 | 1.02 | 1.01 | 1.02 | 0.99 | 0.98 |
| Anti-shudder durability (Comparison with criterion oil) | | >4 | >4 | >4 | >4 | >4 | >4 | >4 |

| | | Inventive Examples | | | | | | |
|---|---|---|---|---|---|---|---|---|
| | | 8 | 9 | 10 | 11 | 12 | 13 | 14 |
| Refined mineral oil[1)] | mass % | 86.697 | 86.697 | 86.697 | 86.697 | 86.597 | 86.597 | 86.597 |
| Oleic acid-modified compound[2)] | mass % | — | — | — | — | — | — | — |
| Boric acid-modified compound[3)] | mass % | — | — | — | — | — | — | — |
| Phosphoric acid-modified compound[4)] | mass % | — | — | — | — | — | — | — |
| Lauric acid-modified compound[5)] | mass % | — | — | — | — | 3 | 3 | 3 |
| Lauric acid-modified compound[6)] | mass % | — | — | — | — | — | — | — |
| Oleic acid-modified compound[7)] | mass % | — | — | — | — | — | — | — |
| Stearic acid-modified compound[8)] | mass % | — | — | — | — | — | — | — |
| Oleic acid-modified compound[9)] | mass % | 3 | — | — | — | — | — | — |
| Oleic acid-modified compound[10)] | mass % | — | 3 | — | — | — | — | — |
| Oleic acid-modified compound[11)] | mass % | — | — | 3 | — | — | — | — |
| Oleic acid-modified compound[12)] | mass % | — | — | — | 3 | — | — | — |
| Succinimide A[13)] | mass % | — | — | — | — | — | — | — |
| Succinimide B[14)] | mass % | — | — | — | — | — | — | — |
| Succinimide C[15)] | mass % | — | — | — | — | — | — | — |
| Friction modifier A[16)] | mass % | — | — | — | — | 0.1 | — | — |
| Friction modifier B[17)] | mass % | — | — | — | — | — | 0.1 | — |
| Metal-based detergent[18)] | mass % | — | — | — | — | — | — | 0.2 |
| Ashless dispersant[19)] | mass % | 3 | 3 | 3 | 3 | 3 | 3 | 3 |
| Boron-modified ashless dispersant[20)] | mass % | 1 | 1 | 1 | 1 | 1 | 1 | 1 |
| Viscosity index improver[21)] | mass % | 5 | 5 | 5 | 5 | 5 | 5 | 5 |
| Anti-wear agent[22)] | mass % | 0.2 | 0.2 | 0.2 | 0.2 | 0.2 | 0.2 | 0.2 |
| Oxidation inhibitor A[23)] | mass % | 0.5 | 0.5 | 0.5 | 0.5 | 0.5 | 0.5 | 0.5 |
| Oxidation inhibitor B[24)] | mass % | 0.5 | 0.5 | 0.5 | 0.5 | 0.5 | 0.5 | 0.5 |
| Corrosion inhibitor[25)] | mass % | 0.1 | 0.1 | 0.1 | 0.1 | 0.1 | 0.1 | 0.1 |
| Anti-foaming agent[26)] | mass % | 0.003 | 0.003 | 0.003 | 0.003 | 0.003 | 0.003 | 0.003 |
| Transmission torque capacity SAE No. 2 $\mu s$ (2000 cycles) | | 0.114 | 0.111 | 0.108 | 0.110 | 0.140 | 0.137 | 0.139 |
| Shifting property SAE No.2 $\mu 0/\mu d$ (100 cycles) | | 0.97 | 0.88 | 0.94 | 0.94 | 0.97 | 0.98 | 0.98 |
| Anti-shudder durability (Comparison with criterion oil) | | >4 | >4 | >4 | >4 | >4 | >4 | >4 |

[1)]hydro-refined mineral oil (kinematic viscosity at 100° C.: 4 $mm^2/s$, viscosity index: 120)
[2)]reaction product of diethylenetriamine bis(n-octadecenyl)succinimide/oleic acid (molar ratio = 1/1)
[3)]reaction product of diethylenetriamine bis(iso-octadecenyl)succinimide/boric acid (molar ratio = 1/1)
[4)]reaction product of diethylenetriamine bis(iso-octadecenyl)succinimide/phosphoric acid (molar ratio = 1/1)
[5)]reaction product of diethylenetriamine bis(iso-octadecenyl)succinimide/lauric acid (molar ratio = 1/1)
[6)]reaction product of diethylenetriamine bis(iso-octadecenyl)succinimide/lauric acid (molar ratio = 1/0.5)
[7)]reaction product of diethylenetriamine bis(iso-octadecenyl)succinimide/oleic acid (molar ratio = 1/1)

TABLE 1-continued

Inventive Examples

[8]reaction product of diethylenetriamine bis(iso-octadecenyl)succinimide/stearic acid (molar ratio = 1/1)
[9]reaction product of triethylenetetramine bis(iso-octadecenyl)succinimide/oleic acid (molar ratio = 1/2)
[10]reaction product of tetraethylenepentamine bis(iso-octadecenyl)succinimide/oleic acid (molar ratio = 1/3)
[11]reaction product of pentaethylenehexamine bis(iso-octadecenyl)succinimide/oleic acid (molar ratio = 1/4)
[12]reaction product of diethylenetriamine mono(iso-octadecenyl)succinimide/oleic acid (molar ratio = 1/2)
[13]diethylenetriamine bis(n-octadecenyl)succinimide

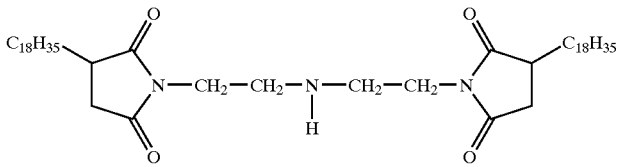

[14]diethylenetriamine bis(iso-octadecenyl)succinimide
[15]diethylenetriamine mono(iso-octadecenyi)succinimide
[16]ethoxylated isostearylamine
[17]condensation product of isostearic acid and tetraethylenepentamine
[18]calcium sulfonate (total base number: 300 mgKOH/g, calcium content: 12 mass %)
[19]polybutenylsuccinimide (bis type, the weight-average molecular weight of the polybutenyl group: 1,000)
[20]boric acid-modified polybutenylsuccinimide (bis type, boron content: 0.5 mass %, the weight-average molecular weight of the polybutenyl group: 1,300)
[21]dispersion type polymethacrylate (weight-average molecular weight: 120,000)
[22]arylphosphite
[23]dialkyldiphenylamine-based oxidation inhibitor
[24]bisphenol-based oxidation inhibitor
[25]tolyltriazole
[26]dimethylsilicone

TABLE 2

| | | Comparative Examples | | | |
|---|---|---|---|---|---|
| | | 1 | 2 | 3 | 4 |
| Refined mineral oil[1] | mass % | 86.697 | 86.697 | 86.697 | 86.697 |
| Oleic acid-modified compound[2] | mass % | — | — | — | — |
| Boric acid-modified compound[3] | mass % | — | — | — | — |
| Phosphoric acid-modified compound[4] | mass % | — | — | — | — |
| Lauric acid-modified compound[5] | mass % | — | — | — | — |
| Lauric acid-modified compound[6] | mass % | — | — | — | — |
| Oleic acid-modified compound[7] | mass % | — | — | — | — |
| Stearic acid-modified compound[8] | mass % | — | — | — | — |
| Oleic acid-modified compound[9] | mass % | — | — | — | — |
| Oleic acid-modified compound[10] | mass % | — | — | — | — |
| Oleic acid-modified compound[11] | mass % | — | — | — | — |
| Oleic acid-modified compound[12] | mass % | — | — | — | — |
| Succinimide A[13] | mass % | — | 3 | — | — |
| Succinimide B[14] | mass % | — | — | 3 | — |
| Succinimide C[15] | mass % | — | — | — | 3 |
| Friction modifier A[16] | mass % | — | — | — | — |
| Friction modifier B[17] | mass % | — | — | — | — |
| Metal-based detergent[18] | mass % | — | — | — | — |
| Ashless dispersant[19] | mass % | 3 | 3 | 3 | 3 |
| Boron-modified ashless dispersant[20] | mass % | 1 | 1 | 1 | 1 |
| Viscosity index improver[21] | mass % | 5 | 5 | 5 | 5 |
| Anti-wear agent[22] | mass % | 0.2 | 0.2 | 0.2 | 0.2 |
| Oxidation inhibitor A[23] | mass % | 0.5 | 0.5 | 0.5 | 0.5 |
| Oxidation inhibitor B[24] | mass % | 0.5 | 0.5 | 0.5 | 0.5 |
| Corrosion inhibitor[25] | mass % | 0.1 | 0.1 | 0.1 | 0.1 |
| Anti-foaming agent[26] | mass % | 0.003 | 0.003 | 0.003 | 0.003 |
| Transmission torque capacity SAE No. 2 $\mu$s (2000 cycles) | | 0.174 | 0.109 | 0.153 | 0.110 |
| Shifting property SAE No.2 $\mu$0/$\mu$d (100 cycles) | | 1.05 | 0.97 | 1.03 | 0.96 |
| Anti-shudder durability (Comparison with criterion oil) | | 0.1 | 3.3 | 2.0 | 3.3 |

[1]hydro-refined mineral oil (kinematic viscosity at 100° C.: 4 $mm^2/s$, viscosity index: 120)
[2]reaction product of diethylenetriamine bis(n-octadecenyl)succinimide/oleic acid (molar ratio = 1/1)
[3]reaction product of diethylenetriamine bis(iso-octadecenyl)succinimide/boric acid (molar ratio = 1/1)
[4]reaction product of diethylenetriamine bis(iso-octadecenyl)succinimide/phosphoric acid (molar ratio = 1/1)

TABLE 2-continued

| | Comparative Examples | | | |
|---|---|---|---|---|
| | 1 | 2 | 3 | 4 |

[5]reaction product of diethylenetriamine bis(iso-octadecenyl)succinimide/lauric acid (molar ratio = 1/1)
[6]reaction product of diethylenetriamine bis(iso-octadecenyl)succinimide/lauric acid (molar ratio = 1/0.5)
[7]reaction product of diethylenetriamine bis(iso-octadecenyl)succinimide/oleic acid (molar ratio = 1/1)
[8]reaction product of diethylenetriamine bis(iso-octadecenyl)succinimide/stearic acid (molar ratio = 1/1)
[9]reaction product of triethylenetetramine bis(iso-octadecenyl)succinimide/oleic acid (molar ratio = 1/2)
[10]reaction product of tetraethylenepentamine bis(iso-octadecenyl)succinimide/oleic acid (molar ratio = 1/3)
[11]reaction product of pentaethylenehexamine bis(iso-octadecenyl)succinimide/oleic acid (molar ratio = 1/4)
[12]reaction product of diethylenetriamine mono(iso-octadecenyl)succinimide/oleic acid (molar ratio = 1/2)
[13]diethylenetriamine bis(n-octadecenyl)succinimide

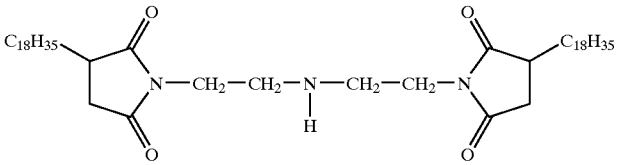

[14]diethylenetriamine bis(iso-octadecenyl)succinimide
[15]diethylenetriamine mono(iso-octadecenyi)succinimide
[16]ethoxylated isostearylamine
[17]condensation product of isostearic acid and tetraethylenepentamine
[18]calcium sulfonate (total base number: 300 mgKOH/g, calcium content: 12 mass %)
[19]polybutenylsuccinimide (bis type, the weight-average molecular weight of the polybutenyl group: 1,000)
[20]boric acid-modified polybutenylsuccinimide (bis type, boron content: 0.5 mass %, the weight-average molecular weight of the polybutenyl group: 1,300)
[21]dispersion type polymethacrylate (weight-average molecular weight: 120,000)
[22]arylphosphite
[23]dialkyldiphenylamine-based oxidation inhibitor
[24]bisphenol-based oxidation inhibitor
[25]tolyltriazole
[26]dimethylsilicone As apparent from the results shown in Tables 1 and 2, the lubricant compositions of Inventive Examples 1 to 14 had an enhanced transmission capacity, an excellent speed-change property, and a long-lasting anti-shudder durability.

In contrast, the composition of Comparative Example 1 which is free of an acid-modified succinimide compound had a poor shifting property and a short anti-shudder durability. The compositions of Comparative Examples 2 to 4 containing a non-acid-modified succinimide were poor in anti-shudder durability.

As described above, the lubricant composition of the present invention has an anti-shudder property for a prolonged period, an enhanced transmission torque capacity, and an excellent shifting property. However, the composition can be used as lubricants not only for automatic transmissions and/or continuously variable transmissions but also construction or agricultural machines equipped with a wet clutch and/or wet brake, manual transmissions, motorcycle gasoline engines, automobile gasoline engines, diesel engines, gas engines and shock absorbers.

We claim:

1. A lubricant composition which comprises a lubricant base oil and at least one compound resulting from the modification of a succinimide represented by formula (1) or (2) below with at least one compound selected from the group consisting of carboxylic acids, triazoles, and derivatives thereof:

(1)

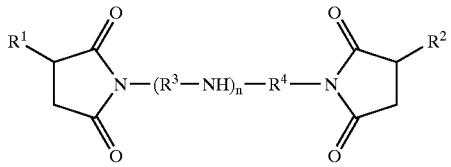

(2)

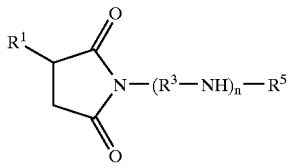

wherein $R^1$ and $R^2$ are the same or different and are each independently a hydrocarbon group having 8 to 30 carbon atoms, $R^3$ and $R^4$ are the same or different and are each independently a hydrocarbon group having 1 to 4 carbon atoms, $R^5$ is hydrogen or a hydrocarbon group having 1 to 30 carbon atoms, and n is an integer from 1 to 7.

2. The lubricant composition according to claim 1, wherein $R^1$ and $R^2$ are each independently a branched hydrocarbon having 8 to 18 carbon atoms.

3. The lubricant composition according to claim 1, wherein n is an integer of 1 or 2.

4. The lubricant composition according to claim 1, further comprising at least one additive selected from the group consisting of friction modifiers and metal-based detergents.

5. The lubricant composition according to claim 4, wherein said friction modifier is selected from the group consisting of amine compounds and derivatives thereof, and said metal-based detergent is selected from the group consisting of sulfonates, phenates, salicylates, and naphthenates.

6. The lubricant composition according to claim 4, wherein said friction modifier is present in an amount of 0.01 to 5 percent by mass, and said metal-based detergent is present in an amount of 0.001 to 0.5 percent by mass of alkaline metal or alkaline earth metal, each percentage being based on a total mass of the composition.

7. The lubricant composition according to claim 1, wherein said modified succinimide compound is present in an amount of 0.01 to 6 percent by mass, based on a total mass of the composition.

8. A lubricant oil composition which comprises a lubricant base oil and at least one compound resulting from modification of a succinimide represented by formula (1) or (2):

(1)

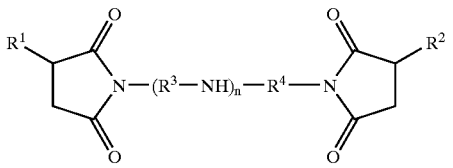

(2)

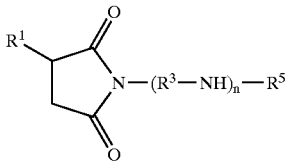

wherein $R^1$ and $R^2$ are the same or different and are each independently a hydrocarbon group having 8 to 30 carbon atoms, $R^3$ and $R^4$ are the same or different and are each independently a hydrocarbon group having 1 to 4 carbon atoms, $R^5$ is hydrogen or a hydrocarbon group having 1 to 30 carbon atoms, and n is an integer from 1 to 7; and wherein the succinimide is modified with at least one compound selected from the group consisting of boric acids, phosphorus acids, sulfuric compounds, and derivatives thereof, and wherein the modification is conducted by reacting at least 0.4 n moles of the at least one compound with 1 mole of the succinimide, where n is as defined above.

9. The lubricant composition according to claim 8, wherein $R^1$ and $R^2$ are each independently a branched hydrocarbon having 8 to 18 carbon atoms.

10. The lubricant composition according to claim 8, wherein n is an integer of 1 or 2.

11. The lubricant composition according to claim 8, further comprising at least one additive selected from the group consisting of friction modifiers and metal-based detergents.

12. The lubricant composition according to claim 11, wherein said friction modifier is selected from the group consisting of amine compounds and derivatives thereof, and said metal-based detergent is at least one compound selected from the group consisting of sulfonates, phenates, salicylates, and naphthenates.

13. The lubricant composition according to claim 11, wherein said friction modifier is present in an amount of 0.01 to 5 percent by mass, and said metal-based detergent is present in an amount of 0.001 to 0.5 percent by mass of alkaline metal or alkaline earth metal, each percentage being based on a total mass of the composition.

14. The lubricant composition according to claim 8, wherein said modified succinimide compound is present in an amount of 0.01 to 6 percent by mass, based on a total mass of the composition.

15. A method for improving anti-shudder durability, transmission torque capacity, and shifting properties in automatic transmissions, continuously variable transmissions, or transmissions having wet clutches and/or wet brakes, the method comprising using a lubricant composition which comprises a lubricant base oil and at least one compound resulting from modification of a succinimide represented by formula (1) or (2):

(1)

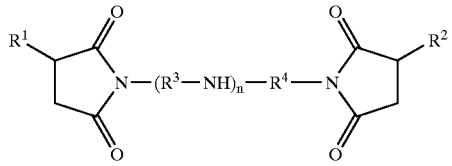

(2)

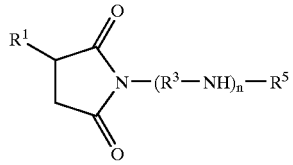

wherein $R^1$ and $R^2$ are the same or different and are each independently a hydrocarbon group having 8 to 30 carbon atoms, $R^3$ and $R^4$ are the same or different and are each independently a hydrocarbon group having 1 to 4 carbon atoms, $R^5$ is hydrogen or a hydrocarbon group having 1 to 30 carbon atoms, and n is an integer from 1 to 7; and wherein the succinimide is modified with at least one compound selected from the group consisting of boric acids, phosphorus acids, sulfuric compounds, and derivatives thereof, and wherein the modification is conducted by reacting at least 0.4 n moles of the at least one compound with 1 mole of the succinimide, where n is as defined above.

16. The method according to claim 15, wherein said lubricant composition further comprises at least one additive selected from the group consisting of friction modifiers and metal-based detergents.

17. The method according to claim 16, wherein said friction modifier is selected from the group consisting of amine compounds and derivatives thereof, and said metal-based detergent is at least one compound selected from the group consisting of sulfonates, phenates, salicylates, and naphthenates.

18. A method for improving anti-shudder durability, transmission torque capacity, and shifting properties in automatic transmissions, continuously variable transmissions, or transmissions having wet clutches and/or wet brakes, the method comprising using a lubricant composition which comprises a lubricant base oil and one or more compounds resulting from the modification of a succinimide represented by formula (1) or (2) below with at least one compound selected from the group consisting of carboxylic acids, triazoles, and derivatives thereof:

(1)

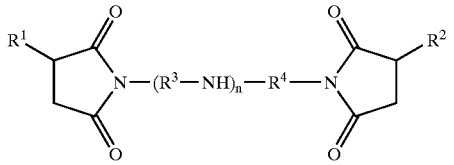

(2)

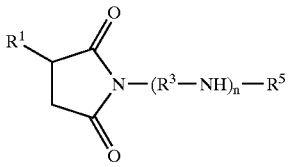

wherein $R^1$ and $R^2$ are the same or different and are each independently a hydrocarbon group having 8 to 30 carbon atoms, $R^3$ and $R^4$ are the same or different and are each independently a hydrocarbon group having 1 to 4 carbon atoms, $R^5$ is hydrogen or a hydrocarbon group having 1 to 30 carbon atoms, and n is an integer from 1 to 7.

19. The method according to claim 18, wherein said lubricant composition further comprises at least one additive selected from the group consisting of friction modifiers and metal-based detergents.

20. The method according to claim 18, wherein said friction modifier is selected from the group consisting of amine compounds and derivatives thereof, and said metal-based detergent is at least one compound selected from the group consisting of sulfonates, phenates, salicylates, and naphthenates.

* * * * *